US008137114B1

(12) United States Patent
Peng

(10) Patent No.: US 8,137,114 B1
(45) Date of Patent: Mar. 20, 2012

(54) BOARD-TO-BOARD ELECTRICAL CONNECTOR

(75) Inventor: Jian Min Peng, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/183,985

(22) Filed: Jul. 15, 2011

(30) Foreign Application Priority Data

May 24, 2011 (CN) ..... 2011 2 0167071 U

(51) Int. Cl.
*H01R 12/00* (2006.01)

(52) U.S. Cl. ..... 439/74; 439/660

(58) Field of Classification Search ..... 439/74, 439/347, 637, 660
See application file for complete search history.

(56) References Cited

U.S. PATENT DOCUMENTS

| | | | | |
|---|---|---|---|---|
| 4,149,764 | A * | 4/1979 | Mattingly, Jr. | 439/75 |
| 4,634,200 | A * | 1/1987 | Dechelette | 439/75 |
| 4,797,113 | A * | 1/1989 | Lambert | 439/74 |
| 5,116,247 | A * | 5/1992 | Enomoto et al. | 439/660 |
| 5,306,163 | A * | 4/1994 | Asakawa | 439/74 |
| 5,842,874 | A * | 12/1998 | Yagi et al. | 439/74 |
| 6,638,078 | B2 * | 10/2003 | Hashiguchi et al. | 439/66 |
| 6,645,005 | B2 * | 11/2003 | Wu | 439/563 |
| 6,875,027 | B2 * | 4/2005 | Ye et al. | 439/74 |
| 6,984,134 | B1 * | 1/2006 | Eakins et al. | 439/78 |
| 7,059,867 | B1 * | 6/2006 | McDermott et al. | 439/66 |
| 7,118,383 | B2 * | 10/2006 | Nagata et al. | 439/63 |
| 7,426,405 | B2 * | 9/2008 | Lee | 455/575.1 |
| 7,494,347 | B1 * | 2/2009 | Wang et al. | 439/74 |
| 7,674,135 | B2 * | 3/2010 | Zeng | 439/660 |
| 7,748,994 | B1 * | 7/2010 | Peng et al. | 439/74 |
| 7,758,352 | B2 * | 7/2010 | Zeng | 439/74 |
| 7,766,666 | B1 * | 8/2010 | Chen et al. | 439/65 |
| 2005/0112949 | A1 * | 5/2005 | Huang | 439/637 |
| 2006/0024985 | A1 * | 2/2006 | Nagata et al. | 439/63 |

* cited by examiner

*Primary Examiner* — Tulsidas C Patel
*Assistant Examiner* — Vladimir Imas
(74) *Attorney, Agent, or Firm* — Morris Mannin & Martin LLP; Tim Tingkang Xia, Esq.

(57) ABSTRACT

A board-to-board electrical connector includes a male plug having a first insulating body and a plurality of male terminals arranged in rows therein, each male terminal has a protrusion which includes a front guide section and a lower bottom supporting section protruding downwards out of a lower surface of the first insulating body; and a female receptacle correspondingly conducting the male plug, which has a second insulating body and a plurality of female terminals arranged in rows therein, each female terminal is opened with a slide hole, a first wide opening is formed therein for the protrusion to insert, so that the bottom supporting section is lower than the first wide opening, a narrow opening of the slide hole is formed for the front guide section to be pressed therein until the bottom supporting section moves under the narrow opening, so that the protrusion is limited in the slide hole.

14 Claims, 5 Drawing Sheets

BOARD-TO-BOARD ELECTRICAL CONNECTOR

CROSS-REFERENCE TO RELATED APPLICATIONS

This non-provisional application claims priority under 35 U.S.C. § 119(a) on Patent Application No. 201120167071.2 filed in China on May 24, 2011, the entire contents of which are hereby incorporated by reference.

FIELD OF THE INVENTION

The present invention relates to a board-to-board electrical connector, and more particularly to a low-height surface mount board-to-board electrical connector.

BACKGROUND OF THE INVENTION

Generally speaking, a printed circuit board is connected to a flexible circuit board through a surface mount board-to-board electrical connector. Usually, a plug welded on the flexible circuit board is engaged with a receptacle welded on the printed circuit board by up and down assembly, so that a contact terminal of the receptacle is electrically connected to a contact terminal of the plug.

Referring to China Patent No. 200620167704, a board-to-board electrical connector is disclosed, see FIG. 6 in the filed patent specification. The board-to-board electrical connector is formed by a first connector 1 (i.e., the plug) and a second connector 2 (i.e., the receptacle) connected to the first connector 1 by insertion. The first connector 1 includes a first body 10 and a plurality of first terminals 15. The second connector 2 includes a second body 20 and a plurality of second terminals 25. The first terminal 15 has a U-shaped upper contact portion 152, and an inner slot 1521 and an outer slot 1522 opposite to the inner slot 1521 are formed on the upper contact portion 152. The second terminal 25 has two lower contact portions 252, and the two lower contact portions 252 are respectively formed with bumps 2521. Therefore, when the first connector 1 is inserted into the second connector 2, the bumps 2521 may respectively urge against the inner slot 1521 and the outer slot 1522 to form electrical connection.

However, the development of the board-to-board electrical connector is in the trend of thin volume. In consideration of reducing the height of the board-to-board electrical connector, the above board-to-board electrical connector has the following defects. (1) The side surface of the first terminal 15 and the side surface of the second terminal 25 are in contact to form the electrical connection, so if the structure of the board-to-board electrical connector is made to be thinner, when the heights of the first terminal 15 and the second terminal 25 are reduced, it is difficult to maintain a sufficient contact area; (2) the bumps 2521 of the second terminal 25 are caught by the inner slot 1521 and the outer slot 1522 of the first terminal 15, so when the heights of the first terminal 15 and the second terminal 25 are reduced, the design technology of the bumps 2521, the inner slot 1521, and the outer slot 1522 needs to be precise and accurate, and this manner of catching is not reliable and may be easily disengaged.

Therefore, it is necessary to design a novel board-to-board electrical connector capable of solving the above problems.

SUMMARY OF THE INVENTION

In one aspect, the present invention is directed to provide a board-to-board electrical connector with a lower height.

In one embodiment, the board-to-board electrical connector of the present invention includes a male plug having a first insulating body and a plurality of male terminals arranged in rows in the first insulating body, in which each male terminal has a protrusion protruding downwards out of a lower surface of the first insulating body, the protrusion has a front guide section and a bottom supporting section lower than the front guide section; and a female receptacle correspondingly conducting the male plug, in which the female receptacle has a second insulating body below the first insulating body and a plurality of female terminals arranged in rows in the second insulating body, a surface of each female terminal is opened with a slide hole, a first wide opening is formed in the slide hole for the protrusion to insert, so that the bottom supporting section is lower than the first wide opening, and a narrow opening of the slide hole is formed by extending from one end of the first wide opening for the front guide section to be pressed into the narrow opening until the bottom supporting section moves to a position under the narrow opening, so that the protrusion is limited in the slide hole. In this manner, the male terminal and the female terminal are conducted.

Compared with the prior art, the front guide section of the present invention is pressed into the narrow opening, and each male terminal is clamped by the corresponding slide hole to form a contact state. The bottom supporting section is located below the narrow opening, and the male terminal and the female terminal are in side-pull engagement by way of being parallel to the flexible circuit board instead of the up and down engagement in the prior art. Therefore, the low-height board-to-board electrical connector can be easily fabricated and this clamping manner realizes a reliable connection.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
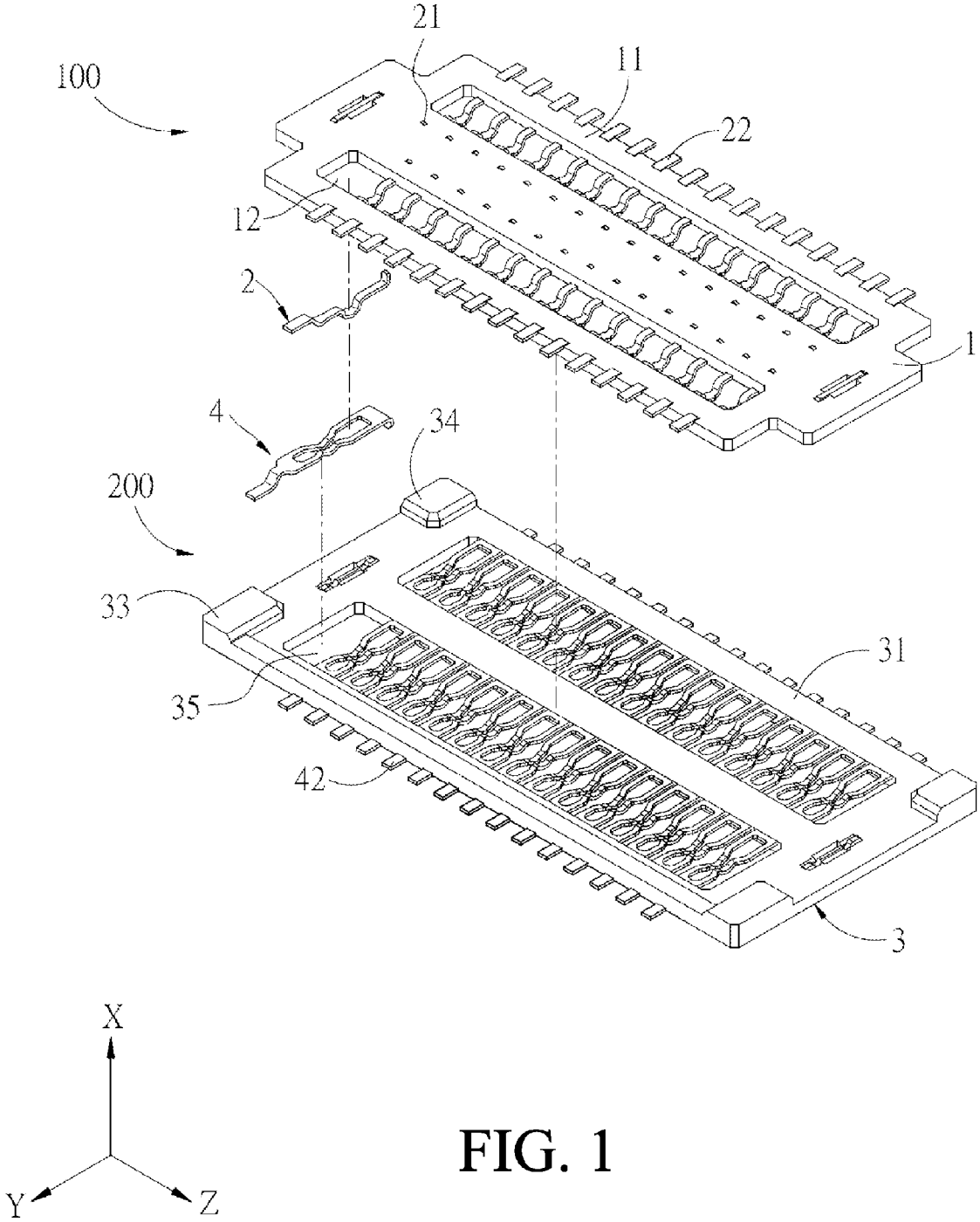
FIG. 1 is an exploded view of a board-to-board electrical connector in one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Referring to FIG. 1, the board-to-board electrical connector in one embodiment of the present invention includes a male plug 100 and a female receptacle 200 below the male plug 100. As shown in FIG. 1, an X direction is defined to be upwards, a Y direction is defined to be forwards, and a Z direction is defined to be rightwards. In this embodiment, the direction terminologies like up, down, front, rear, left, and right are used for illustrating the structures and operation manners of all components of the board-to-board electrical connector. However, the directions indicated by the terminologies are only used for illustrating the orientation of the board-to-board electrical connector in FIG. 1, and when the defined direction of the board-to-board electrical connector changes, the directions indicated by the terminologies will be interpreted into different directions accordingly.

The male plug 100 is substantially plate-shaped and includes a first insulating body 1 and a plurality of male terminals 2. The male terminals 2 are embedded in the first insulating body 1. The first insulating body 1 has a first abutting surface (not shown) facing the female receptacle 200 and a first welding surface 11 opposite to the first abutting surface. The first insulating body 1 is recessed with two first terminal slots 12, and each male terminal 2 straddles the first terminal slot 12, that is, each male terminal 2 is fixed on two opposite sides (for example, in the front and rear directions) of the first terminal slot 12.

The female receptacle 200 may also be substantially plate-shaped and includes a second insulating body 3 and a plurality of female terminals 4. The female terminal 4 is embedded in the second insulating body 3. The second insulating body 3 has a second abutting surface 31 facing the male plug 100 and a second welding surface (not shown) opposite to the second abutting surface 31. The second abutting surface 31 has a first boss 33 and a second boss 34 for confining a moving range of the male plug 100. The second insulating body 3 has two second terminal slots 35, and each female terminal 4 straddles the second terminal slot 35, that is, each female terminal 4 is fixed on two opposite sides (for example, in the front and rear directions) of the second terminal slot 35. Each female terminal 4 fits the corresponding male terminal 2.

Figure 2:
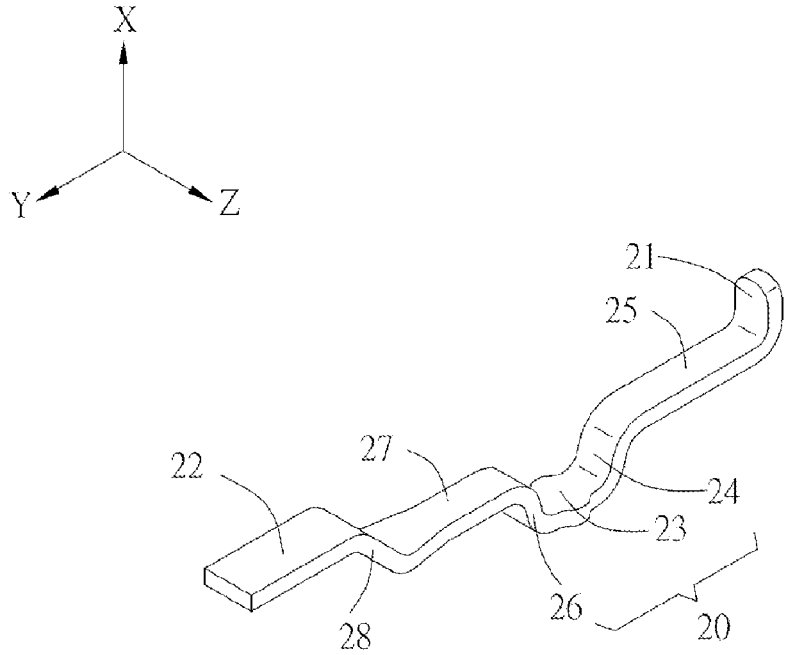
FIG. 2 is a three-dimensional view of a male terminal in FIG. 1.
Figure 3:
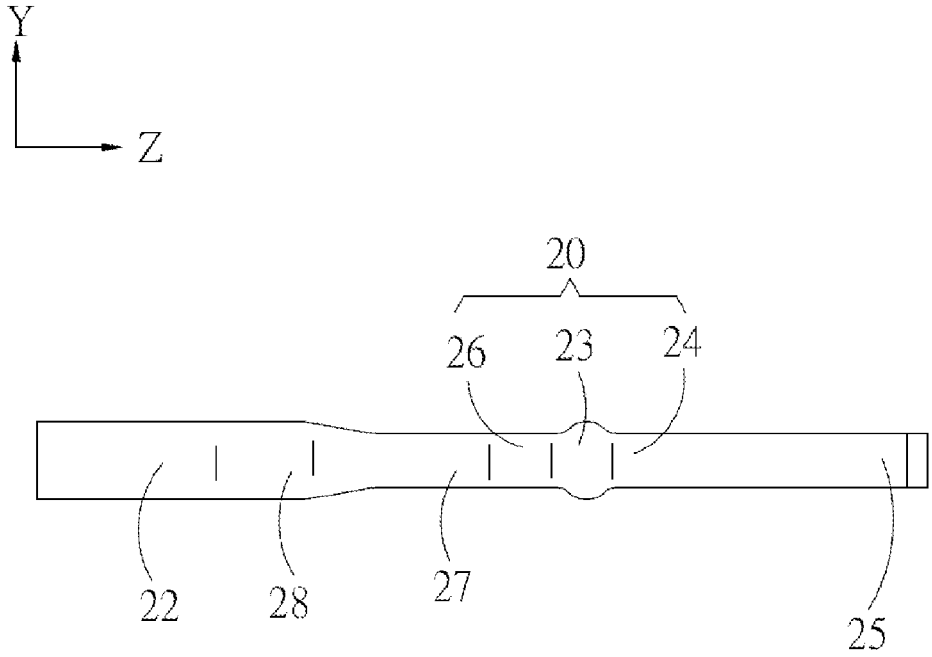
FIG. 3 is a top view of the male terminal in FIG. 1.

Referring to FIG. 2 and FIG. 3, the male terminal 2 is in an elongated shape, and two ends are respectively a first welding leg 21 and a second welding leg 22 and are respectively fixed on two opposite sides of the first terminal slot 12. A protrusion 20 is formed between the two welding legs and the protrusion 20 has a bottom supporting section 23 extending downwards, a front guide section 24, and a rear guide section 26.

The bottom supporting section 23 bends and extends backwards and upwards to form the front guide section 24, and the bottom supporting section 23 bends and extends frontwards and upwards to form the rear guide section 26. The bottom supporting section 23 is lower than any one of the first welding leg 21, the second welding leg 22, the front guide section 24, and the rear guide section 26. The front guide section 24 bends and extends backwards to form a front transition section 25. The front transition section 25 bends backwards vertically to form the first welding leg 21. The rear guide section 26 bends forwards to form a rear transition section 27. The rear transition section 27 bends and extends forwards to form a first bending portion 28. The first bending portion 28 bends and extends forwards to form the second welding leg 22.

Figure 6:
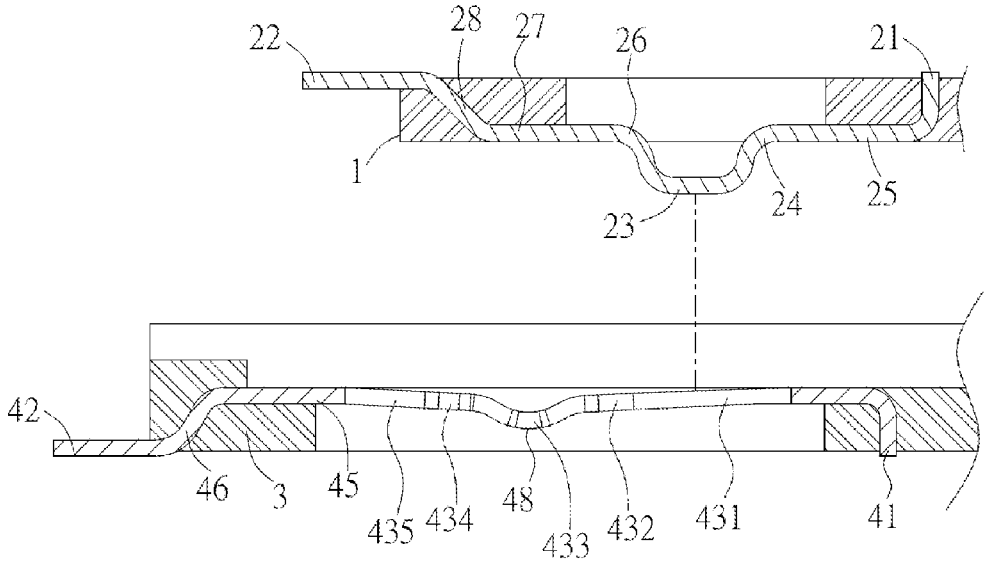
FIG. 6 is a schematic assembly view of a male plug and a female receptacle in FIG. 1.

As shown in FIG. 3, the width of the rear transition section 27 is gradually expanded near the first bending portion 28, and the widths of the first bending portion 28 and the second welding leg 22 are the same and greater than the width of the rest part. The width of the bottom supporting section 23 is greater than the widths of the front guide section 24 and the rear guide section 26. The widths of the front guide section 24, the rear guide section 26, and the front transition section 25 are all the same. Referring to FIG. 6, the plane of the second welding leg 22 is parallel to the plane of the bottom supporting section 23, and the front transition section 25 and the rear transition section 27 are coplanar and are parallel to the plane of the bottom supporting section 23. An end surface of the first welding leg 21 is coplanar with a plane where the second welding leg 22 is located to obtain a good coplanar effect when welded on the flexible circuit board. A part of the first welding leg 21 and the first bending portion 28 are embedded in the first insulating body 1.

Figure 4:
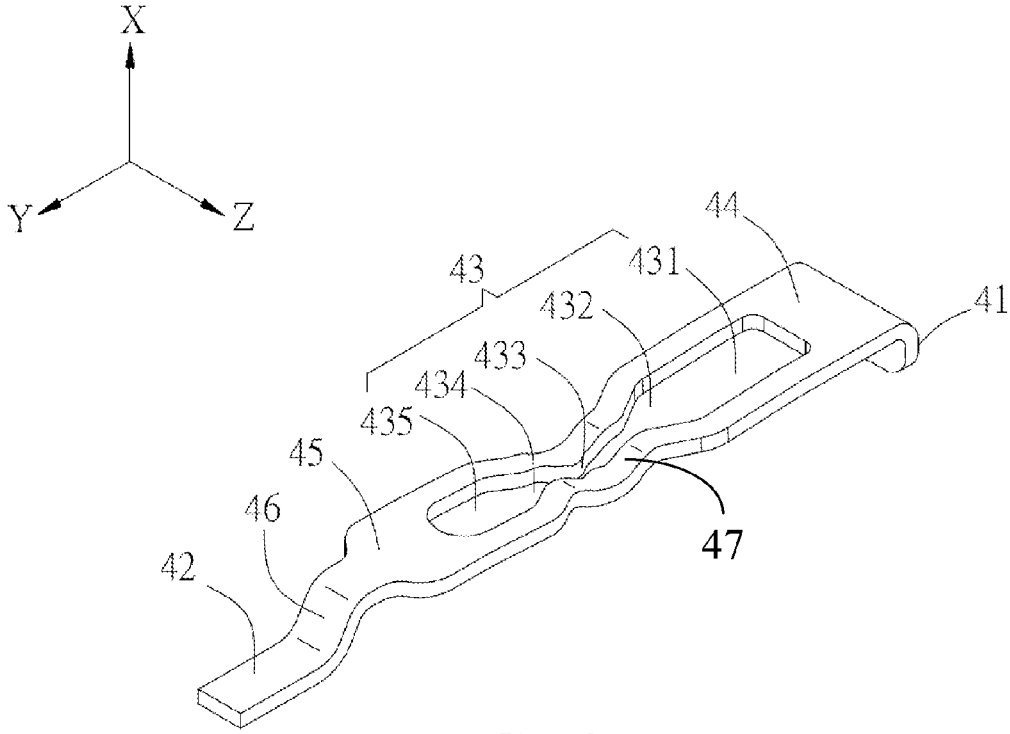
FIG. 4 is a three-dimensional view of a female terminal in FIG. 1.

Referring to FIG. 4, the female terminal 4 is in an elongated shape, and two ends are respectively a third welding leg 41 and a fourth welding leg 42 and are respectively fixed on two opposite sides of the second terminal slot 35. A middle part of the female terminal 4 is punched to form a slide hole 43. The slide hole 43 is substantially in an 8 shape, and includes a first wide opening 431, a front constriction opening 432, a narrow opening 433, a rear constriction opening 434, and a second wide opening 435 sequentially. The first wide opening 431 is gradually reduced towards the narrow opening 433 to form the front constriction opening 432, and the narrow opening 433 is gradually enlarged towards the second wide opening 435 to form the rear constriction opening 434. Therefore, the widths of the front constriction opening 432 and the rear constriction opening 434 are gradually varied, and the reducing extents of the front constriction opening 432 and the rear constriction opening 434 are the same. A front block region 44 is formed between the slide hole 43 and the third welding leg 41, and the front block region 44 bends and extends vertically to form the third welding leg 41. A rear block region 45 is formed between the slide hole 43 and the fourth welding leg 42. A second bending portion 46 is formed between the fourth welding leg 42 and the rear block region 45. Two clamping arms 47 are joint together to form the slide hole 43, and in the up and down directions defined in FIG. 1, the corresponding clamping arm 47 of the narrow opening 433 is arc-shaped. The middle part of the narrow opening 433 has a catch opening 4331, and the catch opening 4331 is formed by bumps 48 extending oppositely from two clamping arms 47.

Figure 5:
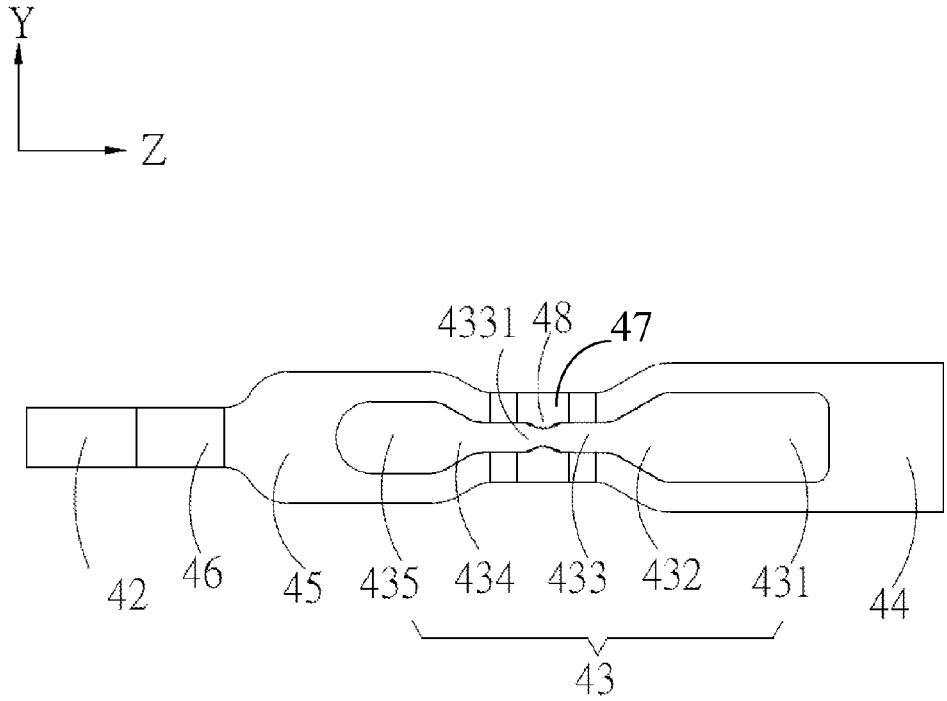
FIG. 5 is a top view of the female terminal in FIG. 1.

Referring to FIG. 5, the widths of the first wide opening 431 and the second wide opening 435 are greater than the width of the narrow opening 433, and the width of the catch opening 4331 is smaller than the width of the rest part of the narrow opening 433. As shown in FIG. 6, an end surface of the third welding leg 41 is coplanar with a plane where the fourth welding leg 42 is located to obtain a good coplanar effect when welded on the printed circuit board. A part of the third welding leg 41 and the second bending portion 46 are embedded in the second insulating body 3.

As shown in FIG. 1, the male terminals 2 are fixed in two rows front and back on the male plug 100. Two rows of the first welding legs 21 are adjacent to each other, and two rows of the second welding legs 22 are far away from each other.

Correspondingly, the female terminals 4 are fixed in two rows front and back on the female receptacle 200. Two rows of the third welding legs 41 are adjacent to each other, and two rows of the fourth welding legs 42 are far away from each other. When the male plug 100 is installed on the female receptacle 200 from the top down, for the female receptacle 200, the male plug 100 has two states, namely, an insertion state and a contact state.

Figure 7:
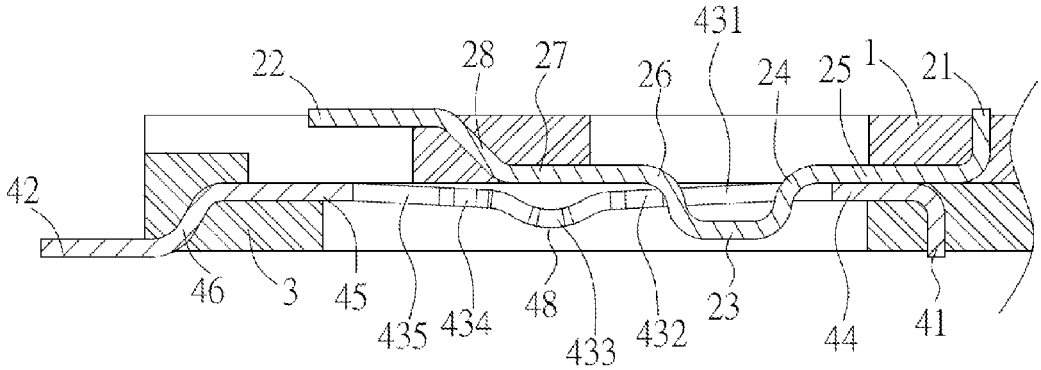
FIG. 7 is a cross-sectional view of the male plug and the female receptacle in FIG. 1 in an insertion state.

As shown in FIG. 7, when the male plug 100 is in an insertion state relative to the female receptacle 200, as the width of the first wide opening 431 is greater than the width of the bottom supporting section 23, the bottom supporting section 23 may be embedded in the first wide opening 431, and the male terminal 2 gets into the female terminal 4 with zero insertion force. Now, the front transition section 25 is located above the front block region 44, and the rear guide section 26 is located above the front constriction opening 432.

Figure 8:
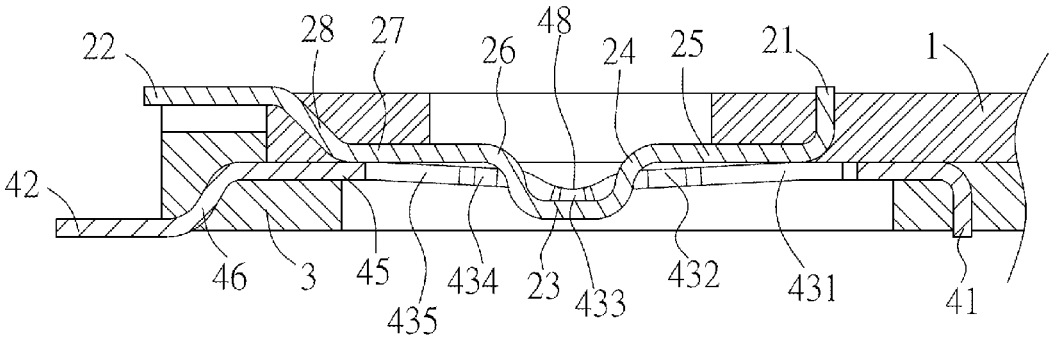
FIG. 8 is a cross-sectional view of the male plug and the female receptacle in FIG. 1 in a contact state.
Figure 9:
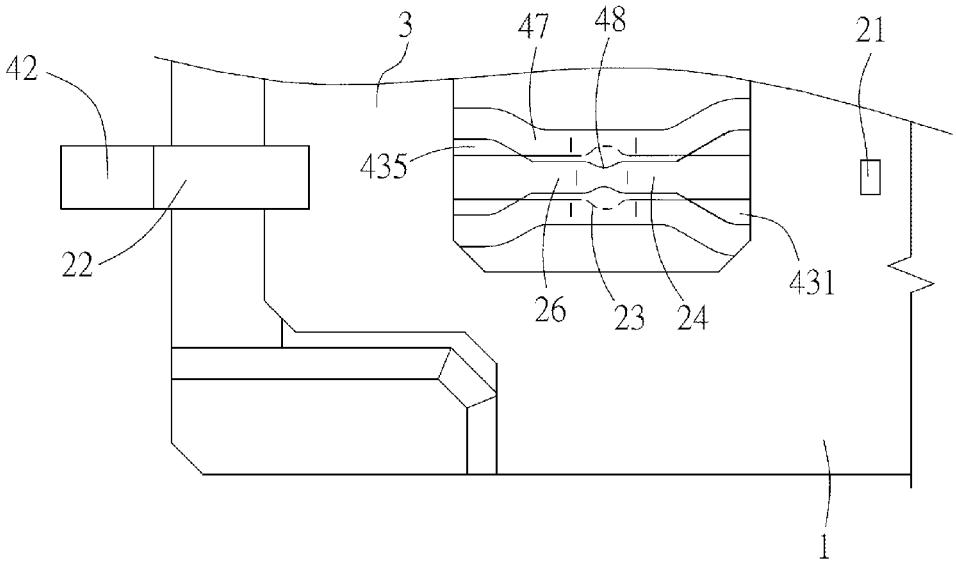
FIG. 9 is a top view of the male plug and the female receptacle in FIG. 1 in the contact state.

As shown in FIG. 8 and FIG. 9, when the male terminal 2 moves towards the catch opening 4331 until the bottom supporting section 23 moves to a position below the narrow opening 433, the male plug 100 changes from the insertion state to the contact state relative to the female receptacle 200. Now, the width of the bottom supporting section 23 is greater than the width of the narrow opening 433, so the bottom supporting section 23 is clamped by the catch opening 4331, and in the up and down directions, the male terminal 2 cannot be disengaged from the female terminal 4 from the top.

The front guide section 24 is clamped by the front constriction opening 432, and left and right side surfaces of the front guide section 24 are in interference contact with two opposite inner side surfaces of the front constriction opening 432. As the widths of the front guide section 24 and the rear guide section 26 are the same and inclined in the same way, the reducing extents of the front constriction opening 432 and the rear constriction opening 434 are the same, when the front guide section 24 is clamped by the front constriction opening 432, the rear guide section 26 is exactly clamped by the rear constriction opening 434, and left and right side surfaces of the rear guide section 26 are in interference contact with two opposite inner side surfaces of the rear constriction opening 434.

The bending extent of the arc-shaped clamping arms 47 on two sides of the catch opening 4331 may be designed through calculation to make the upper surface of the bottom supporting section 23 and the lower surface of the female terminal 4 corresponding to the narrow opening 433 form a compression contact. Therefore, in the contact state, the male terminal 2 and the female terminal 4 have six contact points, which are (1) two contact points formed when the left and right side surfaces of the front guide section 24 are in interference contact with the two opposite inner side surfaces of the front constriction opening 432; (2) two contact points formed when the left and right side surfaces of the rear guide section 26 are in interference contact with the two opposite inner side surfaces of the rear constriction opening 434; and (3) two contact points formed by the upper surface of the bottom supporting section 23 and the lower surface of the deepest recessed position of the corresponding clamping arm 47 of the catch opening 4331.

Alternatively, the first terminal slot 12 may be disposed in a plurality of rows or in a matrix on the first insulating body 1, and correspondingly, the second terminal slot 35 may be disposed in a plurality of rows or in a matrix on the second insulating body 3. The electrical connector of the present invention, among other things, has the following advantages.

(1) The male terminal 2 is embedded in the first insulating body 1, the bottom supporting section 23 straddles the first terminal slot 12, and each male terminal 2 is fixed on two opposite sides of the first terminal slot 12. In this manner, the male terminal 2 may be securely fixed on the first insulating body 1.

(2) The female terminal 4 is embedded in the second insulating body 3, and the female terminal 4 is fixed on two opposite sides of the second terminal slot 35. In this manner, the female terminal 4 may be securely fixed on the second insulating body 3.

(3) In the insertion state, as the width of the first wide opening 431 is greater than the width of the bottom supporting section 23, the male terminal 2 gets into the female terminal 4 with zero insertion force. In the contact state, the front guide section 24 and the rear guide section 26 are together clamped in the narrow opening 433, and the clamping force may be adjusted according to the widths of the front guide section 24 and the front constriction opening 432 and the widths of the rear guide section 26 and the rear constriction opening 434 without influencing the insertion force.

(4) When the male plug 100 changes from the insertion state to the contact state relative to the female receptacle 200, the bottom supporting section 23 passes through the front constriction opening 432 and is clamped by the catch opening 4331. The front guide section 24 is clamped by the front constriction opening 432, and the rear guide section 26 is clamped by the rear constriction opening 434. To release the contact state, a larger force needs to be exerted to move the male terminal 2 from the clamping state of the female terminal 4, so when the insertion state is changed to the contact state until it is hard to pull, the operator may easily understand that it is properly installed.

(5) When the male plug 100 and the female receptacle 200 are in a contact state, the bottom supporting section 23 is located below the narrow opening 433. As the width of the bottom supporting section 23 is greater than the width of the narrow opening 433, the male terminal 2 will not be disengaged from the female terminal 4 in the upward direction, and the male terminal 2 and the female terminal 4 cannot be disengaged in the up and down directions.

(6) Each male terminal 2 is clamped by the corresponding slide hole 43 to form the contact state, and the male terminal 2 and the female terminal 4 are in side-pull engagement by way of being parallel to the flexible circuit board instead of the up and down engagement in the prior art. Therefore, the low-height board-to-board electrical connector can be easily fabricated.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A board-to-board electrical connector, comprising:

(a) a male plug, having a first insulating body and a plurality of male terminals arranged in rows in the first insulating body, wherein each male terminal has a protrusion protruding downwards out of a lower surface of the first insulating body, and the protrusion has a front guide section and a bottom supporting section lower than the front guide section; and (b) a female receptacle, correspondingly conducting the male plug and having a second insulating body below the first insulating body and a plurality of female terminals arranged in rows in the second insulating body, wherein a surface of each female terminal is opened with a slide hole, a first wide opening is formed in the slide hole for the protrusion to insert, so that the bottom supporting section is lower than the first wide opening, a narrow opening of the slide hole is formed by extending from one end of the first wide opening for the front guide section to be pressed into the narrow opening until the bottom supporting section moves to a position under the narrow opening, so that the protrusion is limited in the slide hole; in this manner, the male terminal and the female terminal are conducted.

2. The board-to-board electrical connector according to claim 1, wherein the male terminal has a rear guide section higher than the bottom supporting section.

3. The board-to-board electrical connector according to claim 1, wherein a second wide opening is formed in the slide hole, and the second wide opening and the first wide opening are respectively located at two opposite ends of the narrow opening.

4. The board-to-board electrical connector according to claim 2, wherein the front guide section and the rear guide section are together clamped in the narrow opening.

5. The board-to-board electrical connector according to claim 4, wherein the first wide opening is gradually reduced towards the narrow opening to form a front constriction opening, the narrow opening is gradually enlarged towards the second wide opening to form a rear constriction opening, and when the front guide section is clamped by the front constriction opening, the rear guide section is exactly clamped by the rear constriction opening.

6. The board-to-board electrical connector according to claim 1, wherein a width of the bottom supporting section is greater than a width of the front guide section and is greater than a width of the narrow opening.

7. The board-to-board electrical connector according to claim 6, wherein a compression contact is formed between an upper surface of the bottom supporting section and a lower surface of the female terminal corresponding to the narrow opening.

8. The board-to-board electrical connector according to claim 2, wherein the first insulating body is opened with a first terminal slot, two ends of the male terminal are respectively a first welding leg and a second welding leg which are both higher than the bottom supporting section, and the first welding leg and the second welding leg are respectively fixed on two opposite sides of the first terminal slot.

9. The board-to-board electrical connector according to claim 8, wherein an end surface of the first welding leg is coplanar with a plane where the second welding leg is located.

10. The board-to-board electrical connector according to claim 8, wherein a front transition section is formed between the first welding leg and the front guide section, and the front transition section vertically bends and extends to form the first welding leg.

11. The board-to-board electrical connector according to claim 1, wherein the narrow opening has a catch opening, and a width of the catch opening is smaller than a width of the rest part of the narrow opening.

12. The board-to-board electrical connector according to claim 1, wherein the second insulating body is opened with a second terminal slot, two ends of the female terminal are respectively a third welding leg and a fourth welding leg and are located on two opposite ends of the narrow opening, and the third welding leg and the fourth welding leg are respectively fixed on two opposite sides of the second terminal slot.

13. The board-to-board electrical connector according to claim 12, wherein a front block region is formed between the third welding leg and the first wide opening, and the front block region vertically bends and extends to form the third welding leg.

14. The board-to-board electrical connector according to claim 12, wherein an end surface of the third welding leg is coplanar with a plane where the fourth welding leg is located.

* * * * *